United States Patent [19]

Finkle

[11] Patent Number: 4,903,486

[45] Date of Patent: Feb. 27, 1990

[54] PERFORMANCE RESPONSIVE MUFFLER FOR INTERNAL COMBUSTION ENGINES

[75] Inventor: Louis J. Finkle, Bellflower, Calif.

[73] Assignee: Larry K. Goodman, Cerritos, Calif.

[21] Appl. No.: 259,151

[22] Filed: Oct. 18, 1988

Related U.S. Application Data

[63] Continuation-in-part of Ser. No. 126,657, Dec. 1, 1987, abandoned.

[51] Int. Cl.[4] ..... F01N 3/00

[52] U.S. Cl. ..... 60/324; 181/236; 181/237; 181/254; 181/277; 181/278

[58] Field of Search ..... 60/312, 324; 181/236, 181/237, 254, 277, 278

[56] References Cited

U.S. PATENT DOCUMENTS

| | | | |
|---|---|---|---|
| 733,330 | 7/1903 | New | 181/278 |
| 1,163,128 | 12/1915 | Brauer | 181/278 |
| 3,346,071 | 10/1967 | Lader | 181/236 |
| 3,969,895 | 7/1976 | Krizman | 60/312 |
| 4,161,996 | 7/1979 | Dolejsi | 181/278 |
| 4,699,244 | 10/1987 | Bergquist | 181/254 |

FOREIGN PATENT DOCUMENTS

| | | | |
|---|---|---|---|
| 15737 | 11/1912 | United Kingdom | 181/278 |

*Primary Examiner*—Douglas Hart
*Attorney, Agent, or Firm*—Charles H. Thomas

[57] ABSTRACT

A muffler responsive to exhaust flow rate is provided for an internal combustion engine. The muffler includes a body having a variable restrictor located downstream from an inlet port and upstream from an outlet port of the muffler. The variable restrictor includes a valving element with an operative position which varies as a function of engine exhaust flow rate to occlude exhaust gas flow. The variable restrictor is formed with a solid wall disposed about the valving element to define a constricting annular passageway having a cross section that varies with distance from the inlet port and from the outlet port. The passageway cross section for some mufflers will increase in a direction proceeding from the inlet port toward the outlet port, and will decrease proceeding in that same direction in other mufflers, depending upon the type of internal combustion engine employed.

11 Claims, 3 Drawing Sheets

PERFORMANCE RESPONSIVE MUFFLER FOR INTERNAL COMBUSTION ENGINES

CROSS-REFERENCE TO OTHER PATENT APPLICATIONS

This is a continuation-in-part of applicant's presently copending U.S. patent application Ser. No. 126,657, filed Dec. 1, 1987, entitled "Performance Responsive Muffler For Internal Combustion Engines" and now abandoned.

FIELD OF THE INVENTION

This invention relates to mufflers for internal combustion engines, and in particular to such mufflers which are responsive to the performance of the engine.

BACKGROUND OF THE INVENTION

A muffler is conventionally connected to the outlet from an internal combustion engine to reduce the noise of the exhaust gas stream. The muffler characteristically includes an expansion chamber between its inlet and outlet, which itself will reduce the sound level. In addition, the muffler is often provided with a packing such as glass fibers, or channel means that divide the stream to produce interferences effects which themselves may reduce the sound level.

It is a feature of internal combustion engines, both two cycle and four cycle, that their efficiency is in part a function of the characteristics of its exhaust system. The engine's performance will be improved if the characteristics of the muffler, such as back pressure, match the engine's requirements over a wide range of operating conditions from idling to increased performance. The problem is that the conventional muffler is a fixed and static device that is not operationally adjustable. For this reason its design is a compromise to give better service at a selected performance level, and lesser service at other performance levels. Thus, a muffler which is a very suitable for racing operations may be only marginally acceptable for regular street operation, and one which is suitable for street operations may be only marginally acceptable for high speed operation, and perhaps is also marginally acceptable in all cases at idle. In fact, in high performance operation a conventional muffler may be a poor companion if it must preferably function best at idle.

A muffler to attend to the varying performance requirements should be adjustable to provide an adjustable response, but none is known to exist. This invention provides adjustable means which can be automatically or manually adjusted during operation to respond to the engine performance requirements. In its preferred embodiments, the adjustment will be automatic because a motorcycle rider or the driver of a high performance vehicle, for example, has enough to do already without adjusting the muffler. Automatic adjustments can include means responsive to the exhaust gas stream, and also linkages responsive to throttle settings and other engine parameters. Manual adjustment is also possible although less desirable, such as by means of hand actuated cables and levers that are available to the operator during operation.

This invention comprehends usage in all types of mobile and fixed engine installations, for example, stationary and portable power plants, automobiles, trucks, and motorcycles.

The inventor herein has found that a conventional muffler can be made to be responsive to engine performance in such a way as to improve the engine's efficiency and output by providing an adjustable variable restrictor at the exhaust end of the muffler, and that depending on the engine a throttling down or an opening up at this point with increased exhaust stream flow, does in fact appreciably increase the engine output compared to the same installation and engine setting utilizing the same muffler but without the variable restrictor, while still providing good performance at idle.

It is an object of this invention is to accomplish this objective with a muffler which is automatically responsive to the performance of the engine, and also or instead manually if preferred.

BRIEF DESCRIPTION OF THE INVENTION

A muffler according to this invention has an inlet port and an exhaust port. These respectively enter into and depart from an expansion chamber. Between the expansion chamber and the exhaust port there is a variable restrictor which when in its idle condition exerts a datum resistance to exhaust gas flow. The restrictor can be provided with means such that can throttle down or open up with increased gas flow as preferred for the given installation. However, the same muffler need not be adapted to do both.

In all positions the restrictor permits gas flow adequate for the respective engine performance conditions.

According to one preferred but optional feature of this invention, the restrictor includes a resiliently biased valving member which tends to adjust the restrictor as the flow rate of the exhaust gas stream increases.

According to another preferred but optional feature of the invention, the valving member is axially mounted in the stream flow, with a laterally projecting boundary. The restrictor further includes a tapered boundary, thereby forming an orifice between the valving member and the tapered boundary whose cross-section varies with the position of the valving member in the tapered boundary.

According to still other embodiments, the valving member can be inherently springy so as to variably deflect into the gas stream, or which can be torsionally mounted so as variably to occlude the stream.

According to yet another optional feature of the invention, the position of the valving member is automatically adjustable by linkage either singularly connected to the valving member, or associated with other linkage such as the throttle linkage.

The above and other features of this invention will be fully understood from the following detailed description and the accompanying drawings, in which:

DETAILED DESCRIPTION OF THE INVENTION

Figure 1:
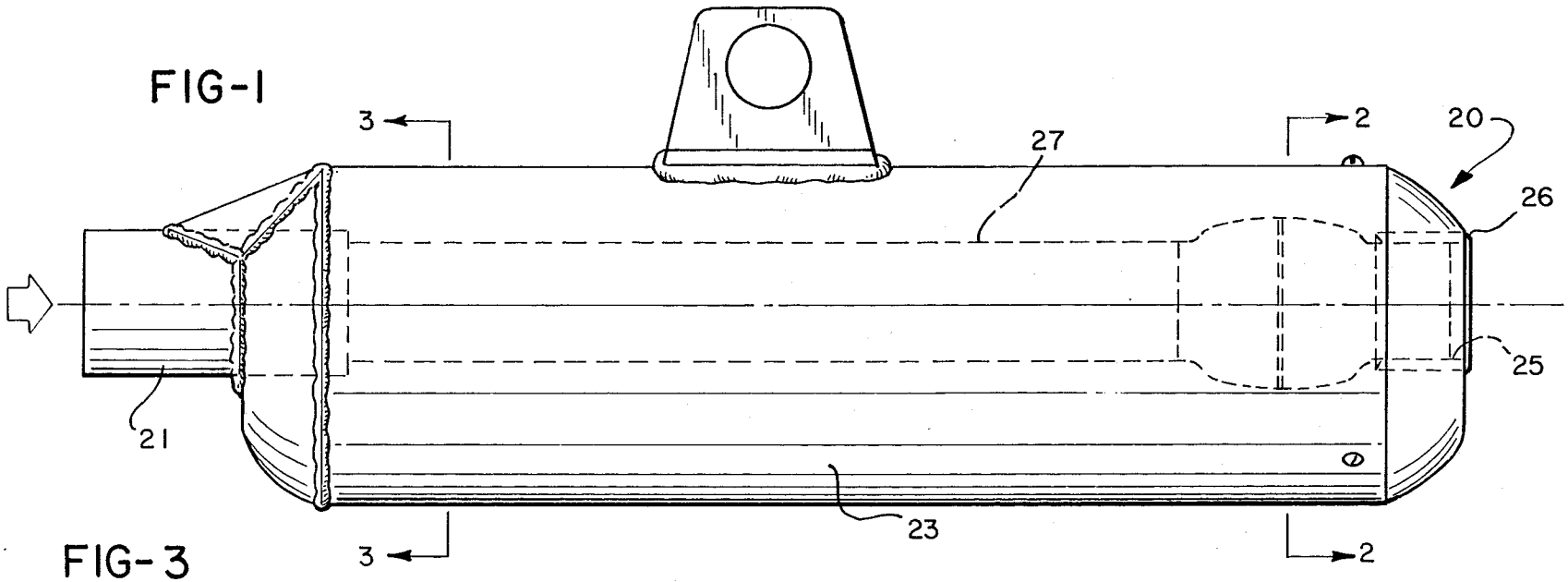
FIG. 1 is a side view of one embodiment of the invention, which throttles down the muffler when engine performance increases.
Figure 2:
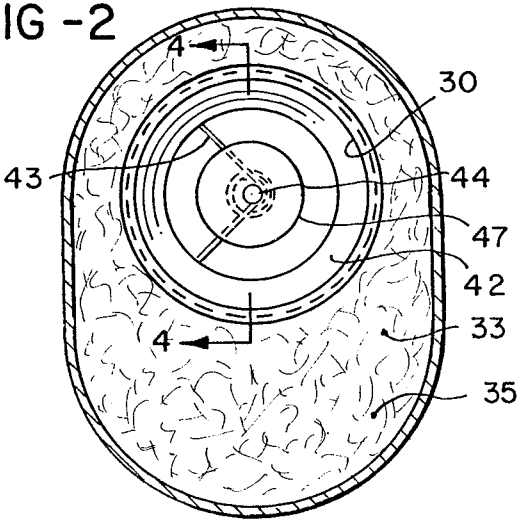
FIG. 2 is a cross-section taken at line 2—2 in FIG. 1.

A muffler 20 according to this invention, has a body with an inlet tube 21 joinable to the exhaust port of a two-cycle engine (not shown) or an extension. It forms an inlet port 22 entering an expansion chamber 23 in the body.

An exhaust port 25 is formed in the opposite end of the body. It conveniently is formed in an outlet tube 26 that extends into the expansion chamber. The expansion chamber is fitted with a diffuser tube 27 that is directly connected to the inlet port, and through a variable restrictor 30 to the exhaust port.

The diffuser tube is cylindrical and has a large number of perforations 32 through it which communicate the flow passage 32 in the diffuser tube with a diffusion cavity 33 between the wall 34 of chamber 23 and the diffuser tube. The diffusion cavity is fitted with a fibrous sound absorbing packing 35. Fiberglass is a suitable packing for this purpose. Any other suitable sound attenuation means can be used instead.

The variable restrictor comprises a valving chamber 40 which has an expanding section 41 and a tapered section 42 leading to the exhaust port. By "tapered" is means an increasing or decreasing diameter. It is not restricted to a conical taper. In fact the shape may be "tailored" to provide the most effective cross-section. As shown it will preferably be somewhat obtuse.

A spider 43 across the exhaust port supports a central post 44 that extends axially upstream. A valving member 45 is slidingly fitted onto the post. It has a circular valving disc 46 with a laterally projecting valving boundary 47. A compression coil spring 48 is fitted on the post in compressive opposition between the spider and the valving member. Suitable limit stops (not shown) can be provided to prevent the movement of the valving disc beyond its illustrated most-open position shown in solid line, and beyond its most-closed position.

The most-closed position of the valving member is shown is dashed line. In both limiting positions, and in the intermediate positions, a restrictor orifice 49 is formed that enables adequate exhaust stream flow for the respective intended operating connection.

The valving member has an impingement face 50, preferably but not necessarily planar, upon which the exhaust stream impinges. The axial movement of the valving member is resilient, and its position along the axis represents a force balance between the spring force and the impingement force. The spring can be prepared with varying constants as a function of compression if desired, so that it can be used to "tailor" the response, also.

The impingement force is a function of mass and velocity of the exhaust stream, which in turn is a function of engine performance. In the embodiment of FIGS. 1–4, in the most-closed position, flow through the restrictor is suitable for idling. When the engine speeds up and gas flow increases, the plate moves into a narrowing region and tends to throttle the flow. Surprisingly, for some engines, especially for some two cycle engines, the increasing resistance to flow improves the engines opening efficiency.

Figure 4:
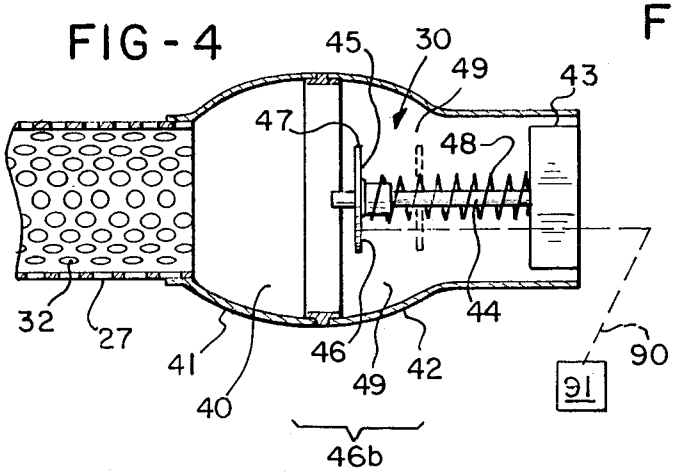
FIG. 4 is a cross-section taken at line 4—4 in FIG. 2.
Figure 3:
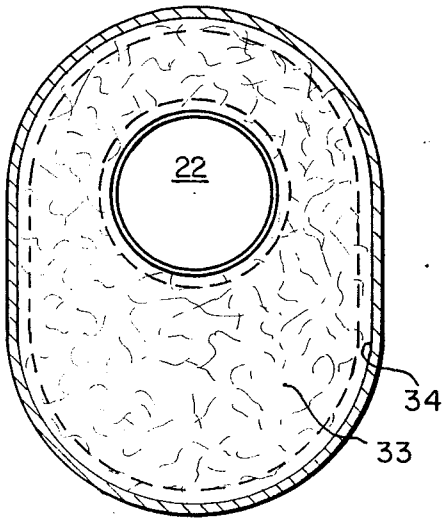
FIG. 3 is a cross-section taken at line 3—3 in FIG. 1.
Figure 5:
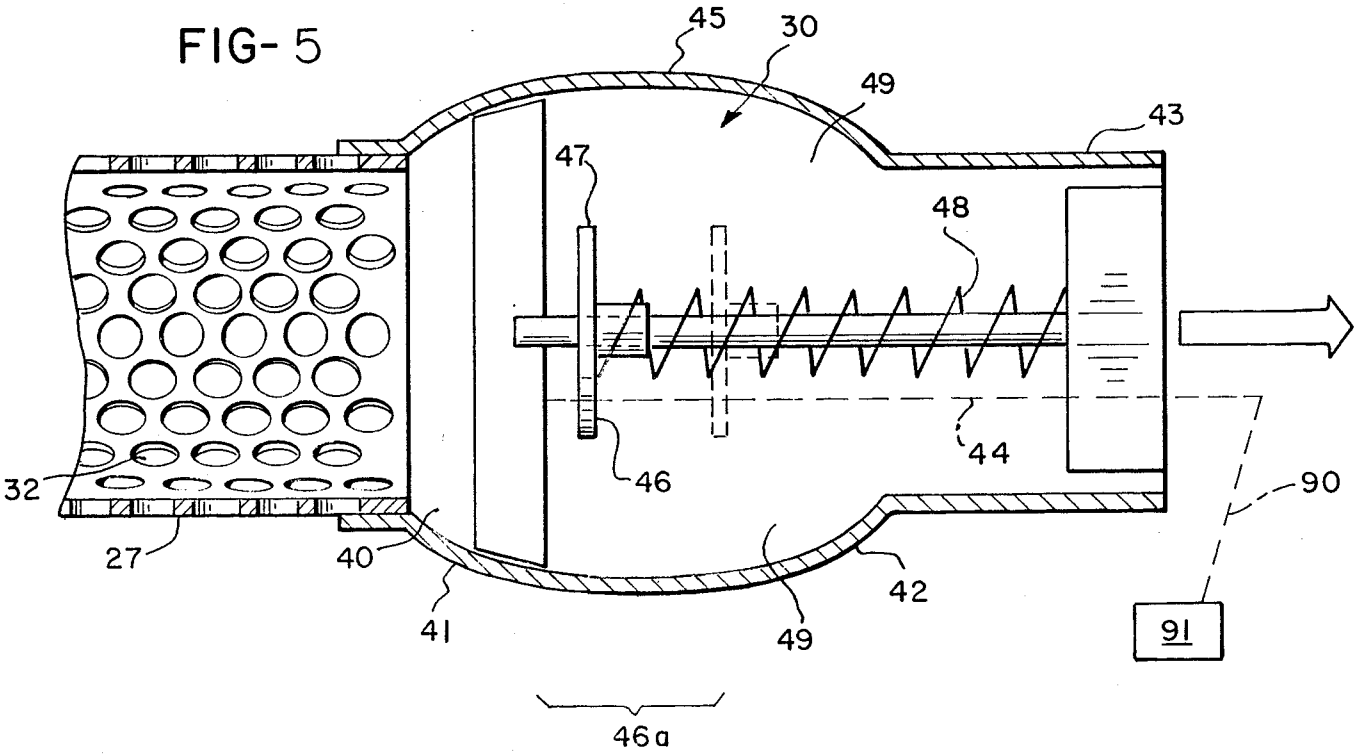
FIG. 5 is a fragmentary showing of another embodiment of the invention similar to FIG. 4, in which the restrictor opens as the gas flow increases.

FIG. 5 illustrates variable restrictor 30 in a reversed sense, such that when the engine speeds up, the restrictor orifice 49 opens up, but continues to exert a restrictive effect. It will be noted that at the idling condition shown in solid line, disc 46 is in an expanding region 46*a* (in FIG. 5), rather than in a reducing region 46*b* (in FIG. 4). In FIG. 4, down stream movement of the disc as the consequence of increasing gas flow impinging on it forces the disc into a region of reduced cross-section thus throttling down the exhaust, as shown in dashed line. Some engines appear to benefit from this throttling down arrangement.

The arrangement of FIGS. 5 and 10–14 are arranged to be the reversal of the embodiments of FIGS. 1–4 and 6–9. In the former, the increased gas flow will press against the respective disc progressively to open the restriction rather than to close it. This arrangement appears to be preferred for four cycle engines in general, and for many two cycle engines.

The restrictor arrangement is identical in FIGS. 4 and 5, except for where the disc is located. In FIG. 5 it moves into an enlarging region, while in FIG. 4 it moves into a decreasing region. Accordingly, the same numbers are used for both embodiments.

The throttling action of the valving member is a function of its axial movement. This is the most convenient, most-readily designed construction. However, the essential function is the changing of the effective cross-section of the variable orifice, and this can also be accomplished by other means.

Figure 6:
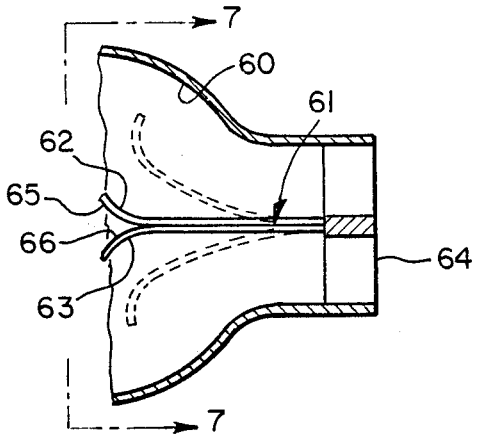
FIG. 6 is a fragmentary cross-section showing another embodiment of the invention.
Figure 7:
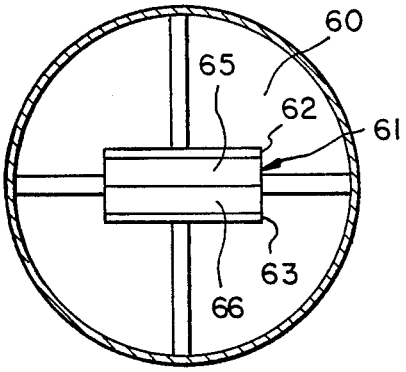
FIG. 7 is a cross-section taken at line 7—7 in FIG. 6.

For example, in FIG. 6, tapered section 60 is the same as tapered section 42 in FIG. 1, and can be substituted directly for it. Its valving member 61 comprises a pair of flexures 62, 63, each of which is anchored to a spider 64. These flexures are springy, and are made of heat resistant steel which maintain its resilience at the elevated operating temperatures. Impingement surfaces 65, 66 face upstream. They are impinged upon by the exhaust gas stream. The most-open position is shown in solid line, where the impingement force of the gas stream is insufficient to deflect the flexures. The most-closed position is shown in dashed line. The latter position is assumed when the gas stream is the consequence of maximum performance. To reverse the effect, to provide increased suction with increased fast flow, the device would merely be reversed, and the rest normal position would be that shown in dashed lines.

Figure 8:
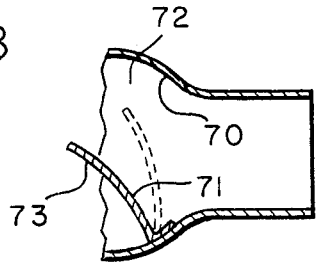
FIG. 8 is a fragmentary cross-section of still another embodiment of the invention.
Figure 9:
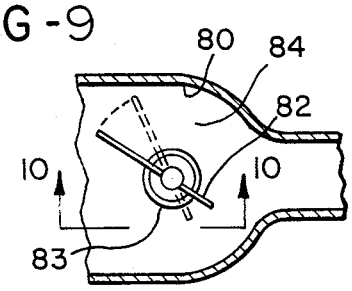
FIG. 9 is a fragmentary cross-section of yet another embodiment of this invention.

FIG. 8 shows that the valving element need not be centrally placed. In this embodiment, a tapered section 70, which can directly be substituted for tapered section 42 in FIG. 1, has a single flexure 71 made of material having the same properties as flexures in FIG. 85 and 86. In its most-open position shown in solid line, the flexure is relaxed. In its most-closed position, shown in dashed line, the impingement forces have deflected the flexure to decrease the cross-section area of the variable orifice 72. The flexure has an impingement face 73 facing upstream. The forces exerted on this surface by the gas stream also cause settings intermediate between those illustrated. Again to reverse the effect, the device would be reversed in the gas stream.

Figure 10:
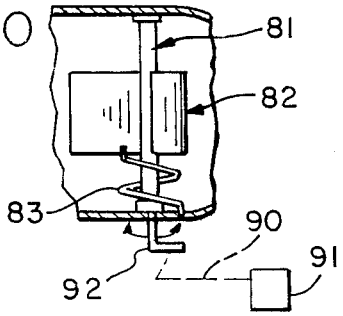
FIG. 10 is a fragmentary cross-section taken at line 10—10 in FIG. 9.

FIG. 10 shows that the valving element can be rotary instead of flexible or axially shiftable. In this embodiment, tapered section 80 can be directly substituted for section 42 in FIG. 1. A rotary spindle 81 extends across the tapered section. It carries a valving element 82 in the form of a vane. Preferably but not necessarily the vane projects laterally farther from one side than from the other so that the shorter one acts as a partial counterbalance.

A torsion spring 83 is attached to the wall and to the vane so as resiliently to oppose the closing of the variable orifice 84. Again, intermediate positions will result from varying gas flow conditions. Reversal of the valve arrangement could provide for increasing flow section.

The foregoing examples all show adjustability as a function of reaction with the exhaust gas stream. Instead it is possible to set it as a function of other external controls such as the throttle control, or by a separate control, for example a handlecontrolled cable.

The structures of FIGS. 1 and 10 are readily suited to such applications. For example in FIGS. 1 and 10, linkage 90 is shown schematically connected to other controls 91 such as the throttle linkage or to a handle (not shown). It may be a lever type linkage or a cable type linkage as preferred, and the setting will be automatic when responsive to other controls, or manual when separately operated by the operator. Also, of course, the controls 91 may be directly responsive to pressure or other conditions in the muffler, and still be within the scope of the invention.

In FIG. 10, a bellcrank 92 is shown where it will turn the vane in response to linkage 90 and controls 91 for the same purposes as just discussed.

The dimensions and characteristics of the muffler and of its parts must be determined experimentally, for each engine and for its intended performance. The amount of throttling must not be such as to prevent ready exhaust of the stream, or to interfere with good idling characteristics. It is principally intended to produce back pressure and back pulse effects in the engine which will improve its performance. For whatever reason, and the reasons may not be fully or even correctly understood at this time, variable throttling at the exhaust end of the muffler, increasing or decreasing with the increasing engine rpm and output, depending on the type of engine, has proved in practice to improve the engine's performance while still providing suitable sound attenuation.

This invention is not to be limited to the embodiments shown in the drawings and described in the description, which are given by way of example and not of limitation, but only in accordance with the scope of the appended claims.

I claim:

1. An engine muffler responsive to exhaust flow rate for an internal combustion engine, comprising:

a body forming an internal expansion chamber and having an inlet port and an exhaust port spaced apart from one another, to receive and to discharge exhaust gas stream, respectively, and a variable restrictor downstream from said inlet port and upstream from said outlet port, through which said exhaust gas stream must flow to reach said exhaust port, said variable restrictor including a valving element whose operative position can variably occlude said gas stream flow as a function of engine exhaust flow rate, and wherein said variable restrictor is formed with a solid wall disposed about said valving element to define a constricting annular passageway having a cross section that varies with distance from said inlet port and from said exhaust port.

2. A muffler according to claim 1 in which said valving element opens as a function of increase engine exhaust flow rate.

3. A muffler according to claim 1 in which said valving element comprises a post mounted in stationary fashion relative to said wall downstream from said inlet port and directed toward said inlet port, an impingement member mounted on said post and movable in reciprocal fashion relative thereto, and resilient means biasing said impingement member toward said inlet port.

4. A muffler according to claim 3 in which said impingement member is a disc.

5. A muffler according to claim 4 in which said impingement member has a planar face directed toward said inlet port.

6. A muffler according to claim 1 in which said operative position is adjustable by external means.

7. A muffler according to claim 6 in which said means is a linkage.

8. A muffler according to claim 7 in which said linkage is responsive to an engine operating condition.

9. A muffler according to claim 7 in which said linkage is manually adjustable by an operator.

10. A muffler according to claim 3 wherein said wall disposed about said valve element is tapered inwardly from said inlet port toward said outlet port, whereby said cross section of said passageway decreases with distance from said inlet port and increases with distance from said outlet port.

11. A muffler according to claim 1 in which said valving element throttles down as a function of increased engine exhaust flow rate.

* * * * *